US010588807B2

(12) United States Patent
Wakabayashi et al.

(10) Patent No.: US 10,588,807 B2
(45) Date of Patent: Mar. 17, 2020

(54) INCUBATOR

(71) Applicant: ATOM MEDICAL CORPORATION, Bunkyo-ku, Tokyo (JP)

(72) Inventors: Keisuke Wakabayashi, Saitama (JP); Masato Honda, Saitama (JP); Yutaka Sekiguchi, Saitama (JP); Ichiro Matsubara, Tokyo (JP); Terumi Matsubara, Tokyo (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 111 days.

(21) Appl. No.: 15/348,318

(22) Filed: Nov. 10, 2016

(65) Prior Publication Data

US 2017/0135887 A1 May 18, 2017

(30) Foreign Application Priority Data

Nov. 16, 2015 (JP) ..... 2015-223756

(51) Int. Cl.
*A61G 11/00* (2006.01)

(52) U.S. Cl.
CPC ..... *A61G 11/006* (2013.01); *A61G 11/005* (2013.01); *A61G 2203/78* (2013.01)

(58) Field of Classification Search
CPC . A61G 11/006; A61G 11/005; A61G 2203/78
See application file for complete search history.

(56) References Cited

U.S. PATENT DOCUMENTS 6,155,970 A * 12/2000 Dykes ..... A61G 11/00 5/610
6,336,897 B1 * 1/2002 Mackin ..... A61G 11/00 292/242
2003/0153805 A1 * 8/2003 Gryn ..... A61G 11/00 600/22

(Continued)

FOREIGN PATENT DOCUMENTS

JP 2003-47634 A 2/2003
JP 2012-223320 A 11/2012

(Continued)

OTHER PUBLICATIONS

Office Action, and English language translation thereof, in corresponding Japanese Application No. 2015-223756, dated Dec. 20, 2016, 8 pages.

*Primary Examiner* — Kaylee R Wilson
(74) *Attorney, Agent, or Firm* — Brinks Gilson & Lione

(57) ABSTRACT

An incubator comprising a mattress tray and a plurality of baby guards surrounding a vicinity of an outer periphery of the mattress tray, wherein: a first baby guard from out of the plurality of baby guards includes a grommet; the first baby guard is detachably attached to a first attachment location installed at a vicinity of the outer periphery of the mattress tray; a second baby guard from out of the plurality of baby guards is detachably attached to a second attachment location installed at a vicinity of the outer periphery of the mattress tray; and the first baby guard is detachable from the first attachment location and attachable to the second attachment location, and the second baby guard is detachable from the second attachment location and attachable to the first attachment location.

6 Claims, 5 Drawing Sheets

(56) References Cited

U.S. PATENT DOCUMENTS

| | | | | |
|---|---|---|---|---|
| 2010/0004502 | A1* | 1/2010 | Honma | A61G 11/00 600/22 |
| 2010/0249493 | A1* | 9/2010 | Chilton, III | A61G 11/00 600/22 |
| 2012/0269568 | A1* | 10/2012 | Matsubara | A61G 11/006 403/104 |

FOREIGN PATENT DOCUMENTS

| | | | | | |
|---|---|---|---|---|---|
| JP | 2014-3369 | A | | 1/2014 | |
| JP | 2014014441 | A | * | 1/2014 | |
| JP | 2014033769 | A | * | 2/2014 | A61G 11/001 |

* cited by examiner

INCUBATOR

RELATED APPLICATIONS

This application claims priority under 35 U.S.C. § 119 to Japanese Patent Application No. 2015-223756 filed on Nov. 16, 2015, the entire content of which is hereby incorporated by reference.

BACKGROUND OF THE INVENTION

1. Field of the Invention

Preferred embodiments relate to an incubator including a mattress tray that an infant can be laid on, and plural baby guards capable of surrounding the vicinity of an outer periphery of the mattress tray, wherein at least one baby guard from out of the plural baby guards includes a grommet.

2. Description of the Related Art

Incubators are already known, such as that described in Japanese Patent Application Publication (JP-A) No. 2012-223320 (referred to below as "the Patent Document"). In the incubator described in the Patent Document, a flat container shaped bed base is installed on an incubator base. The incubator stand is respectively installed with the following so as to form a substantially rectangular shape overall in plan view: a fixed wall section that generally configures a wall section on a head side of an infant (a fixed baby guard); a leg side movable wall section that generally configures a wall section on a leg side of the infant (a movable baby guard); a left side movable wall section that generally configures a wall section on a left side of the infant (a movable baby guard); and a right side movable wall section that generally configures a wall section on a right side of the infant (a movable baby guard). A substantially cuboid shaped infant accommodation space open on an upper face is configured by the mattress tray, or in other words by a mattress on the mattress tray, and by the single fixed wall section and the three movable wall sections which may each be substantially rectangular shaped and may be substantially transparent. The three movable wall sections and the single fixed wall section are each configured overall from a substantially transparent plastic sheet. The three movable wall sections are swingable to-and-fro between an upstanding state substantially upward (referred to below as "the upstanding state") and a hanging state substantially downward (referred to below as "the hanging state"), by swinging about swing support shafts that are installed on left and right sides, or front and rear sides, in the vicinity of lower edges in the upstanding state of the three movable wall sections. The fixed wall section is fixed by being firmly attached to the incubator stand. Moreover, a grommet member is attached to the fixed wall section.

SUMMARY OF THE INVENTION

In the incubator of the Patent Document, when a doctor or nurse or the like is performing some kind of treatment or the like in the proximity of the head of the infant, due to the presence of an ancillary equipment support column in the vicinity of the fixed wall section generally configuring a wall section on the head side of the infant, the doctor or nurse or the like needs to perform treatment in the proximity of the head of the infant from the vicinity of the support column. The doctor or nurse or the like might conceivably perform treatment in the proximity of the head of the infant by switching over the head side of the infant and the leg side of the infant. However, when resuscitation equipment is being employed for the infant, this results in breathing tubes from the resuscitation equipment extending over a comparatively long gap from the grommet member on the fixed wall section to the proximity of the head of the infant. The breathing tubes accordingly may become twisted or kinked by the infant's own body movements, making it difficult to achieve a good supply of breathing gas from the breathing tubes to the infant.

In consideration of the above circumstances, an object of preferred embodiments is to provide an incubator that effectively solves the problem described above with the incubator of the Patent Document, using a comparatively simple configuration.

An incubator of a first aspect of the disclosure includes a mattress tray configured to accommodate an infant laid thereon, and plural baby guards configured to surround a vicinity of an outer periphery of the mattress tray. A first baby guard f of the plural baby guards includes a grommet, and the first baby guard is detachably attached to a first attachment location installed at a vicinity of the outer periphery of the mattress tray. A second baby guard of the plural baby guards is detachably attached to a second attachment location installed at a vicinity of the outer periphery of the mattress tray. The first baby guard is detachable from the first attachment location and attachable to the second attachment location, and the second baby guard is detachable from the second attachment location and attachable to the first attachment location. In such a configuration, the first baby guard including the grommet and the second baby guard that does not include a grommet can be interchanged with each other, thereby enabling a doctor or nurse or the like to attach the first baby guard to a convenient location. There is accordingly hardly any concern that the breathing tubes or the like might be twisted or kinked by the infant's own body movements and the like. In cases in which the first baby guard or the second baby guard has been damaged, etc., then the at least one baby guard out of the first and second baby guards can be replaced with a spare baby guard as required. The first baby guard includes the grommet and the second baby guard does not include a grommet, thereby enabling plural baby guards to be provided at a comparatively low cost compared to cases in which both the first baby guard and the second baby guard include grommets.

In a second aspect of the present disclosure, the plural baby guards include a front side baby guard formed by the second baby guard, a rear side baby guard formed by the first baby guard, and a left side baby guard and a right side baby guard. Such a configuration enables an incubator with a comparatively simple structure and comparatively simple handling to be provided. In a third aspect of the present disclosure, an infant accommodation space having a substantially rectangular shape in plan view is configured by the plural baby guards. Such a configuration enables an incubator with a comparatively simple structure and comparatively simple handling when multiple incubators are handled at the same time to be provided. In a fourth aspect of the present disclosure, the incubator is an open incubator. Since the incubator is an open incubator, an incubator with a simple structure and simple handling can be provided.

Other objects, characteristics, and advantages of the present disclosure as described above should easily become clear from reading the following detailed description, relating to the attached drawings.

BRIEF DESCRIPTION OF THE DRAWINGS

Preferred embodiments will be described in detail based on the following figures, wherein.

DETAILED DESCRIPTION OF THE PREFERRED EMBODIMENTS

Next, explanation follows regarding an exemplary embodiment of the present disclosure as applied to an open incubator (a so-called infant warmer) with reference to the drawings, under the headings:

1. Brief Explanation of Overall Incubator,
2. Explanation of Inner Wall Section Structure,
3. Explanation of Configuration of Outer Wall Section Structure, and
4. Explanation of Operation of Outer Wall Section Structure.

1. Brief Explanation of Overall Incubator

Figure 1:
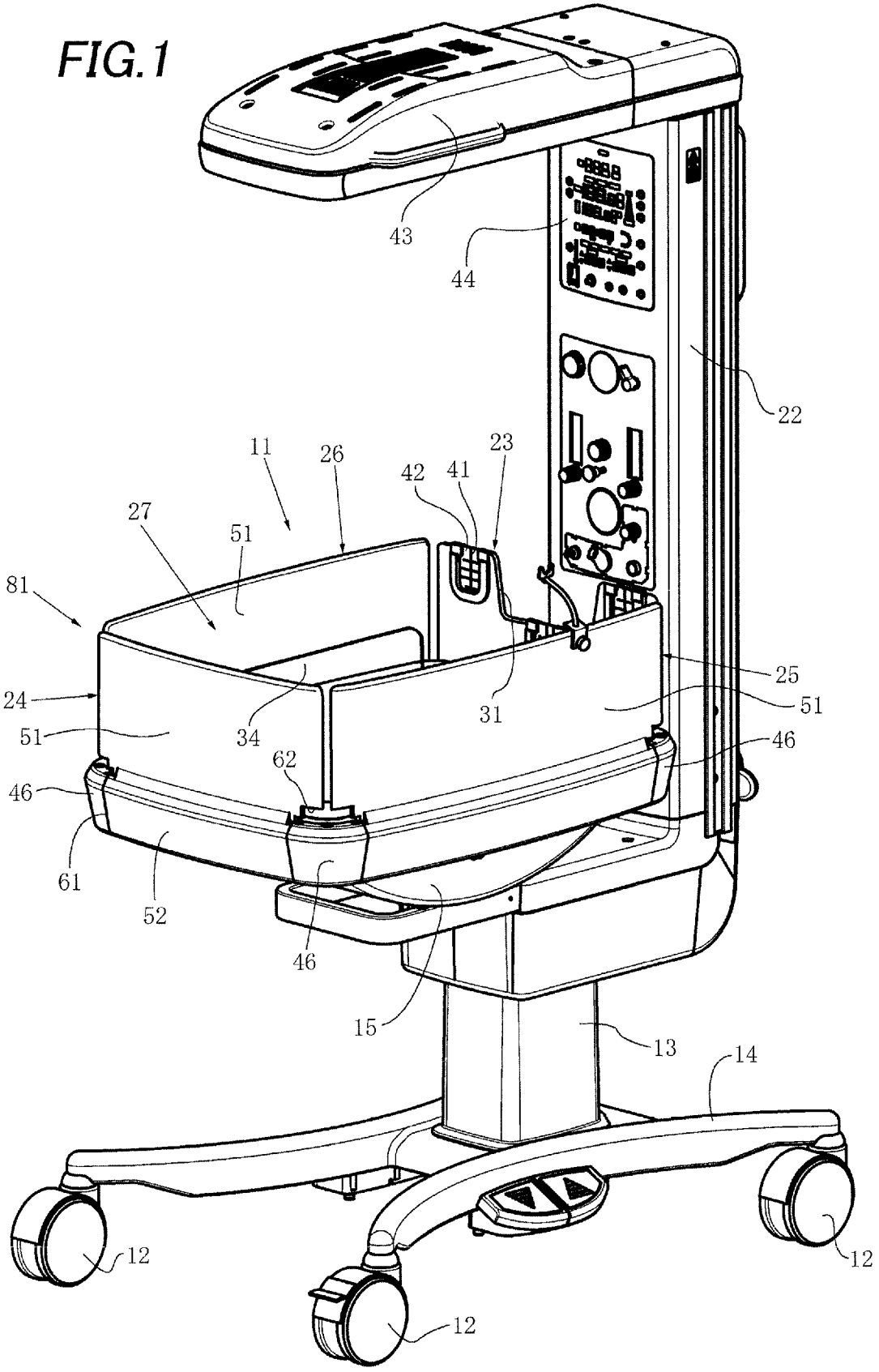
FIG. 1 is a perspective view of an open incubator of an exemplary embodiment of the present disclosure, in a normal use state.
Figure 2:
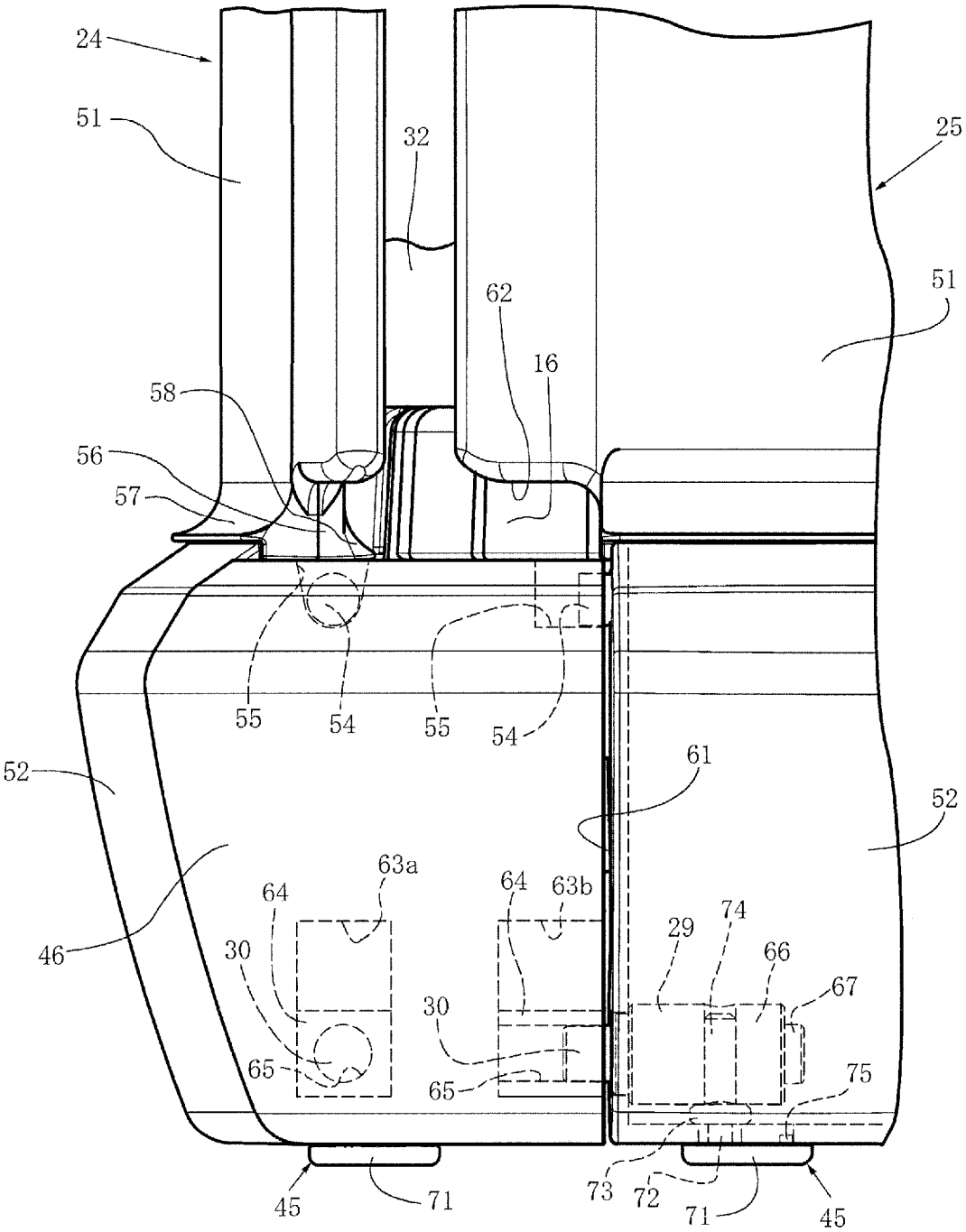
FIG. 2 is a partial side view of an infant accommodation system of the open incubator illustrated in FIG. 1, as viewed from a substantially front face in the vicinity of a lower portion of a corner on the left side at the front.
Figure 4:
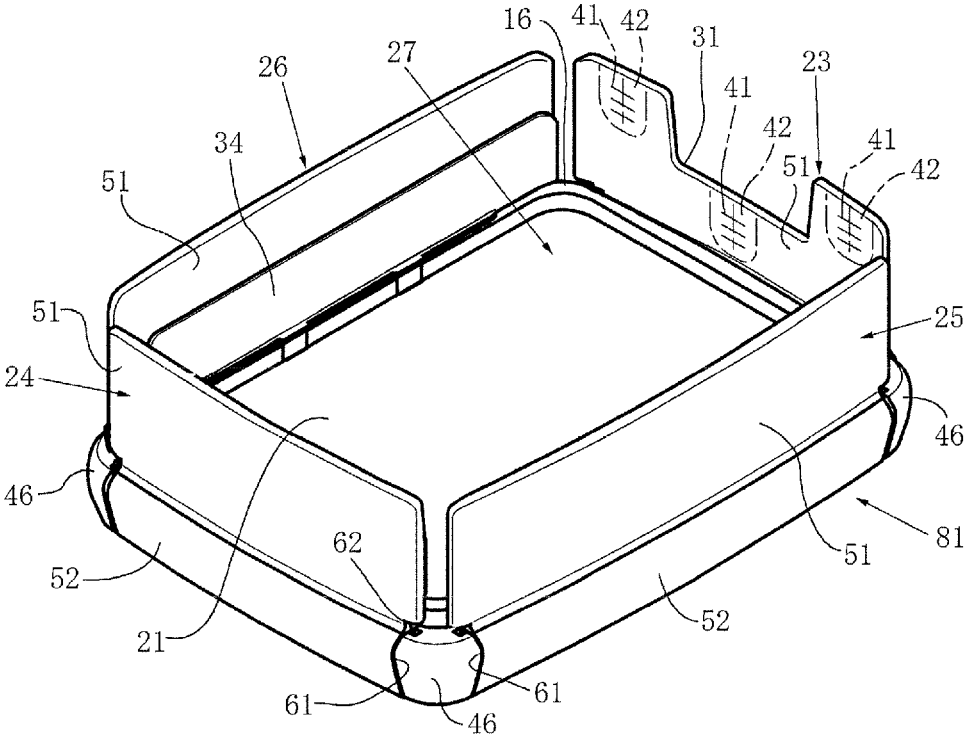
FIG. 4 is a perspective view of an infant accommodation system of an open incubator as illustrated in FIG. 1.

An open incubator 11, as illustrated in FIG. 1, includes a trolley 14, to which wheels 12 and a main pillar 13 are respectively attached. More specifically, the wheels 12 are attached below four corners of the trolley 14, and the main pillar 13 is attached above the trolley 14. An incubator base 15 is then installed above the main pillar 13. A flat container shaped mattress tray 16 is installed, as illustrated in FIG. 1, FIG. 2, FIG. 4, etc., onto the incubator base 15. Moreover, a mattress 21 can be laid on the mattress tray 16 to enable an infant, such as a newborn baby, to be laid thereon.

The mattress tray 16 that has been installed by being attached and fixed onto the incubator base 15 is respectively installed with the following, as illustrated in FIG. 1 and FIG. 2, so as to form a substantially rectangular shape overall in plan view: an outer wall section (an outer baby guard) 23 normally generally configuring an outer wall section on a head side of an infant, or the rear side, adjacent to an ancillary equipment support column 22 installed to the main pillar 13; an outer wall section (an outer baby guard) 24 normally generally configuring an outer wall section on a leg side of an infant, or the front side; an outer wall section (an outer baby guard) 25 normally generally configuring an outer wall section on a left side of an infant; and an outer wall section (an outer baby guard) 26 normally generally configuring an outer wall section on a right side of an infant. A substantially cuboid shaped infant accommodation space 27 open an upper face is configured by the mattress tray 16 (in other words, the mattress 21) and the outer wall sections 23 to 26 that respectively may be substantially rectangular shaped, and may be substantially transparent. Note that the left side outer wall section 25 and the right side outer wall section 26 may have substantially the same dimensions as each other. The outer wall section 23 and the outer wall section 24, which have lengths in their respective length directions (in other words, horizontal directions) that are slightly shorter than those of the outer wall sections 25, 26, may have substantially the same dimensions as each other, except for a cutout shaped indentation 31 that is provided at the outer wall section 23 so as to extend from a substantially central portion of an upper edge of the outer wall section 23 to partway toward the lower edge thereof. The outer wall sections 23 to 26 may be respectively configured from sheets of plastic, such as polycarbonate resin or acrylic resin, which are substantially transparent overall.

Figure 3A:
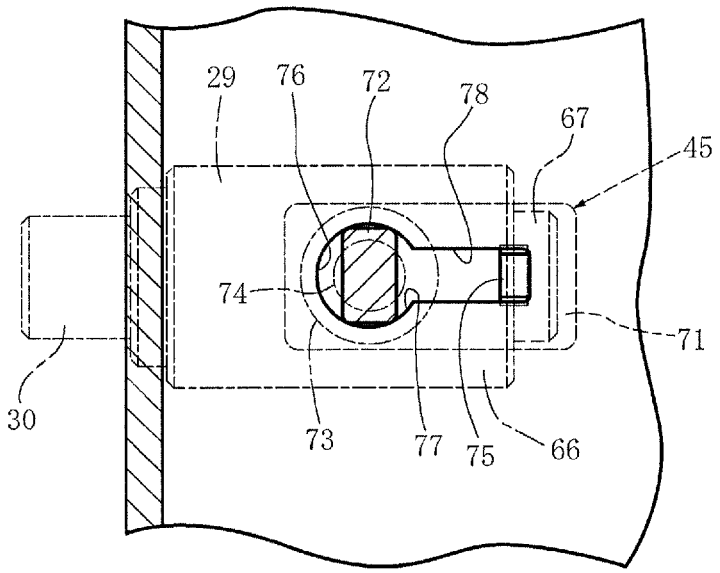
FIG. 3A is a partial horizontal cross-section of a wall attachment-detachment operation mechanism illustrated in FIG. 2, illustrated in a state in which an operation member has not yet been operated.
Figure 3B:
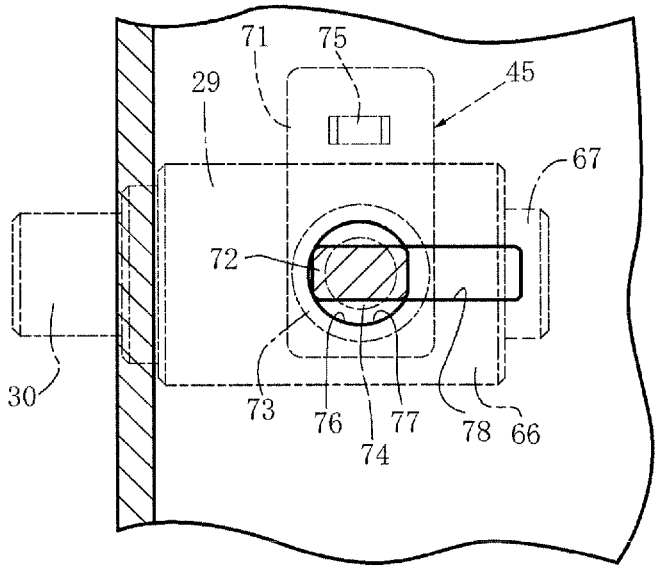
FIG. 3B is a similar horizontal cross-section to FIG. 3A of the wall attachment-detachment operation mechanism illustrated in FIG. 3A, illustrated in a state in which the operation member is in a first operation state.
Figure 3C:
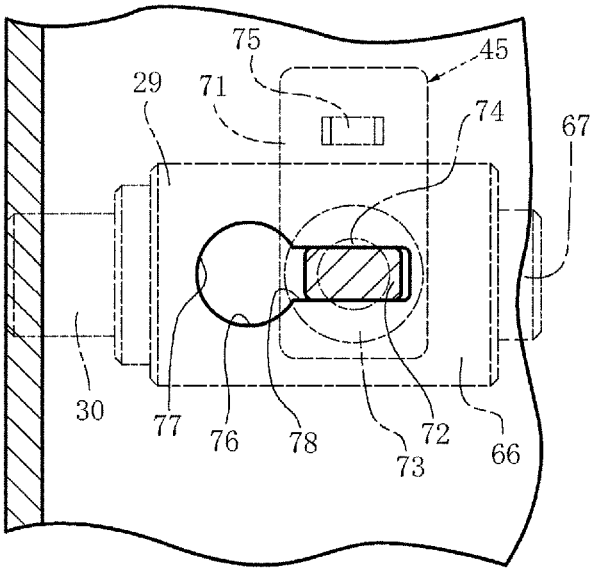
FIG. 3C is a similar horizontal cross-section to FIG. 3A of the wall attachment-detachment operation mechanism illustrated in FIG. 3A, illustrated in a state in which the operation member is in a second operation state.

Each of the outer wall sections 24 to 26 is swingable to-and-fro between a substantially upstanding state (referred to below as "the upstanding state") as illustrated in FIG. 1 and FIG. 2, and a hanging state substantially downward illustrated in FIG. 6 (referred to below as "the hanging state"; however, in FIG. 6, the outer wall section 26 is illustrated in the upstanding state), by swinging about swing support shafts 30 of swing support shaft members 29 arranged on the left and right sides, or the front and rear sides, in the vicinity of the lower edges of the outer wall sections 24 to 26 in the upstanding state illustrated in FIG. 1. The outer wall section 23 is also, in substantially the same manner as the outer wall section 24, axially supported by swing support shafts (not illustrated in the drawings) on the left and right sides. Each of the swing support shafts 30 illustrated in FIG. 2 and FIG. 3A to FIG. 3C can be shifted out from an engaged state with an attachment member 46 as illustrated in FIG. 2 and FIG. 3A, through an intermediate state as illustrated in FIG. 3B, to a non-engaged state with the attachment member 46 as illustrated in FIG. 3C, by a user manually performing a shift-out operation with an operation member 45. Moreover, each of the swing support shafts 30 can be shifted back to the engaged state by a user manually performing a shift-back operation that is a reverse of the shift-out operation on the operation member 45 in the non-engaged state.

Figure 6:
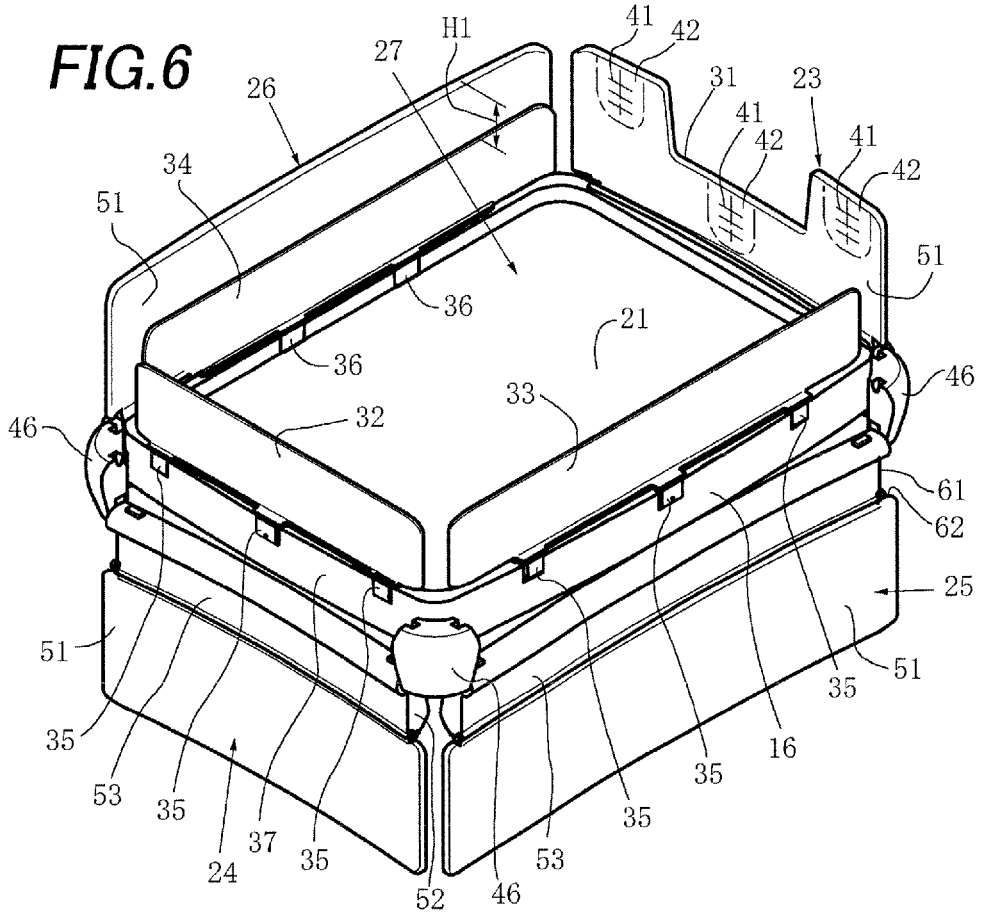
FIG. 6 is a perspective view of the infant accommodation system illustrated in FIG. 4, in a state in which the leg side outer wall section and a left side outer wall section have each been opened.

At the outer periphery of the mattress tray 16, as illustrated in FIG. 6, there are, for example, three inner wall sections 32, 33, 34 respectively arranged along the outer periphery of the mattress tray 16 so as to form a substantially U-shape overall in plan view. The inner wall sections 32 to 34 may respectively be configured from sheets of plastic, such as polycarbonate resin or acrylic resin, which are substantially transparent overall. The leg side inner wall section 32 may be attached to the mattress tray 16 so as to project substantially upward in the vicinity of a leg side end portion of the mattress tray 16, so as to be detachable therefrom. The inner wall sections 33, 34 on the left side and the right side may be respectively attached to the mattress tray 16 so as to project substantially upward from the respective end portions on the left side and the right side of the mattress tray 16, so as to be detachable therefrom.

As illustrated in FIG. 1, etc., an appropriate number (three in this exemplary embodiment) of grommet members 42 having notches 41 for holding cables may be respectively attached to a portion of the outer wall section 23 adjacent to a lower end of the cutout shaped indentation 31 and to portions of the outer wall section 23 adjacent to the left and right ends of the indentation 31. Elongated shaped members (not illustrated in the drawings) such as oxygen supply tubes may be held in the notches 41 in a state in which they pass through the grommet members 42. An infrared heater 43 is installed at an upper end of the ancillary equipment support column 22. Moreover, various measuring and control devices 44 for body temperature, $SpO_2$, and the like are installed to the ancillary equipment support column 22 at positions substantially between the infrared heater 43 and the infant accommodation space 27 as viewed from the front. Specifically, configuration may be made such that a body temperature controller from out of the measuring and control devices 44 is input with a signal from a body temperature probe that measures the body temperature of the infant and displays the body temperature, so as to be able to control a heating temperature and the like of the infrared heater 43.

2. Explanation of Inner Wall Section Structure

Figure 5:
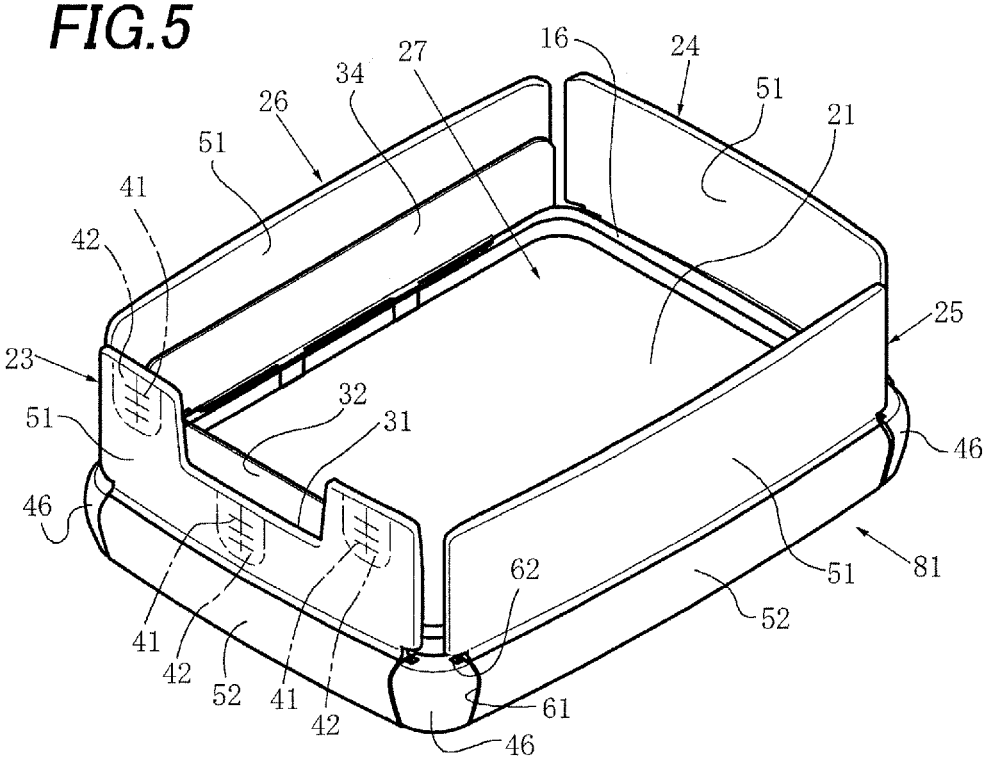
FIG. 5 is a perspective view of the infant accommodation system illustrated in FIG. 4, in a state in which a head side outer wall section and a leg side outer wall section have been installed exchanged with each other.

The leg side inner wall section 32, as illustrated in FIG. 4 to FIG. 6, extends at the vicinity of the leg side end of the mattress tray 16 for substantially the entire length thereof. The left side inner wall section 33 extends at the vicinity of the left side end of the mattress tray 16 for substantially the entire length thereof. The right side inner wall section 34 extends at the vicinity of the right side end of the mattress tray 16 for substantially the entire length thereof. Moreover, due to the left and right ends of the inner wall section 32 being respectively separated from the front ends of the inner wall sections 33, 34, the inner wall sections 32 to 34 are each respectively configured as a separate component. However, the left and right ends of the inner wall section 32 may be coupled to the front ends of the inner wall sections 33, 34. In such cases, the inner wall sections 32 to 34 may be configured as a single frame body of substantially U-shape overall. The inner wall sections 32 to 34 are respectively equipped with attachment protrusions 35 that may each have a substantially L-shape projecting downward.

Specifically, as illustrated in FIG. 6, three, for example, of the attachment protrusions 35 are arranged at each of the inner wall sections 32 to 34, such as by integral molding, so as to project downward from outer faces thereof. Two, for example, attachment protrusions 36 are arranged at each of the inner wall sections 32 to 34, such as by integral molding, so as to project downward from inner faces thereof. When the inner wall sections 32 to 34 are attached to side walls 37 of the mattress tray 16, the attachment protrusions 35 and the attachment protrusions 36 respectively abut the outer faces and the inner faces of the side walls 37 of the mattress tray 16. Thus, the side walls 37 are respectively interposed between the attachment protrusions 35 and 36, such that the inner wall sections 32 to 34 are respectively fixed to the side walls 37 of the mattress tray 16 so as to be detachable therefrom.

3. Explanation of Configuration of Outer Wall Section Structure

As illustrated in FIG. 1, FIG. 2, and FIG. 6, the outer wall sections 23 to 26 each includes a wall section body 51, and a support member 52 that is fixed by screws (not illustrated in the drawings) to a lower end of the respective wall section body 51. Substantially the entire inner face of the lower end of the respective wall section body 51 is covered by a cover member 53. At the vicinity of the two ends on the left and right, or front and rear, sides of the lower ends of the respective support members 52, the outer wall sections 23 to 26 are attached to the attachment members 46 by a pair of the swing support shafts 30 so as to be capable of swinging. The attachment members 46 are respectively attached so as to be fixed to substantially the four corners of the mattress tray 16. A left and right pair of shaft bearing guides 63*a*, 63*b*, each configured by an indentation that is substantially elongated along the up-down direction, are formed at the respective inside face of each attachment member 46 on the left and right side of the attachment member 46. Moreover, a bearing member 64 that may be of substantially cuboid shape is housed in each of the respective left and right pair of the shaft bearing guides 63*a*, 63*b* so as to be capable of moving substantially up and down (in other words, substantially up-down movable). A through hole 65 or a bind hole, which have a substantially circular shape in vertical cross-section and extends in a substantially horizontal direction, is formed at each bearing member 64. Moreover, a left and right pair of swing support shaft guides (not illustrated in the drawings), which is elongated in a substantially left-right direction and is shaped as substantially circular cylindrical indentations, is formed, such as by integral molding, at the left and right of the inside face of each support member 52.

A support shaft body 66 of each of the swing support shafts 30, as illustrated in FIG. 3A, etc., is formed so as to be elongated in a substantially left-right direction and is substantially circular cylindrical shaped. A protrusion 67 for latching a spring onto protrudes from a side end face of the support shaft body 66 on the opposite side to that of the swing support shaft 30. Note that a spring (not illustrated in the drawings) engaged with one end of the protrusion 67 elastically biases the swing support shaft member 29 toward substantially the left in FIG. 3A. The operation member 45 includes a knob 71, which is a large, substantially rectangular shape or the like, for swinging and sliding the operation member 45. A lock portion 72, which is a small, substantially rectangular shape or the like, is contiguously provided to the knob 71, such as by integral molding. Furthermore, a detachment stopper 73, which is substantially circular shaped, is contiguously provided to the lock portion 72, such as by integral molding. An engagement shaft 74, which is an elongated substantially circular cylindrical shape, is contiguously provided to the detachment stopper 73, such as by integral molding. On an inside face of the knob 71, a rotation stopper 75, which is a substantially trapezoidal shaped plate portion as viewed from the right in FIG. 3A, is contiguously provided to the knob 71, such as by integral molding. Moreover, a through hole 76, which is a substantially keyhole shape, is formed at the support member 52. The through hole 76 is configured including a first opening 77 of substantially circular shape, and a second opening 78 that is connected to the first opening 77 and of substantially rectangular shape.

As illustrated in FIG. 2, FIG. 6, etc., a pair of coupling members 54 that are respectively arranged at both substantially horizontal direction sides of the outer wall sections 23 to 26, engage with a pair of engaged portions 55 respectively arranged at both substantially horizontal direction sides of the attachment members 46, so as to be detachable therefrom. The lower ends of the respective wall section bodies 51 of the outer wall sections 23 to 26 each extend partway down the respective support member 52, further downward than an intermediate position of the respective support member 52 in a substantially up-down direction. A portion of the respective wall section body 51 of the outer wall sections 23 to 26 that is adjacent to and substantially above the upper face of the support member 52 is configured as a thickened portion 56 having a substantially triangular shaped vertical cross-section, as illustrated in FIG. 1, FIG. 2, etc. The thickened portions 56 are each arranged along substantially the entire length of the respective outer wall sections 23 to 26 in a substantially horizontal direction (in other words, in the substantially length direction thereof). Thus, in order to prevent dirty water, dust, or the like from entering between the lower end of the respective wall section body 51 and the support member 52, and between the lower end of the wall section body 51 and the cover member 53, one side 57 of a lower end face in the thickness direction of the thickened portion 56 abuts substantially the upper face of the support member 52, and another side 58 of the lower end face abuts substantially the upper face of the cover member 53.

The outer wall section 23, as illustrated in FIG. 1, FIG. 4 to FIG. 6, etc., is formed in substantially the same shape as the leg side outer wall section 24, except for the outer wall section 23 having the cutout shaped indentation 31 and the grommet members 42. The left side outer wall section 25 may be formed in substantially the same shape as the right side outer wall section 26. In order to form escape sections for the four attachment members 46 at the two ends of the respective support members 52 of the outer wall sections 23 to 26, cutouts 61 are respectively provided to portions corresponding to the attachment members 46. The substantially horizontal direction lengths of the respective support members 52 are thereby formed slightly shorter than the substantially horizontal direction lengths of the respective wall section bodies 51 of the outer wall sections 23 to 26. Cutouts 62 are also provided connected to the respective cutouts 61 in the vicinity of the lower ends at the respective left and right sides, or front and rear sides, of the wall section bodies 51 of the outer wall sections 23 to 26 when in the upstanding state. Moreover, as illustrated in FIG. 1, FIG. 2, FIG. 4, etc., in the upstanding state, the respective outer wall sections 23 to 26 curve in an arc so as to protrude slightly from the inside toward the outside as viewed in a substantially plan view. When respectively viewing the outer wall sections 23 to 26 in the upstanding state from a substantially plan view, a length direction central portion of the respective outer wall sections 23 to 26 has a substantially circular arc shape of comparatively large diameter (in other words, a substantially circular arc shape having a comparatively small amount of curvature), and the two length direction end portions of the respective outer wall sections 23 to 26 are each a substantially circular arc shape having a comparatively small diameter (in other words, a substantially circular arc shape having a comparatively large amount of curvature). The respective outer wall sections 23 to 26 are curved bodies having no substantially angular portions and continuing from one end portion from out of the two end portions, through the central portion, to the other end portion from out of the two end portions.

A height difference H1 (see FIG. 6) in a substantially vertical direction between the upper end of the respective outer wall section 24 to 26 in the upstanding state and the upper end of the respective inner wall section 32 to 34 is approximately 84.5 mm in the illustrated exemplary embodiment. From a practical perspective, the height difference H1 is generally preferably within a range of from 56.3 mm to 112.7 mm, is more preferably in a range of from 63.4 mm to 105.6 mm, and is most preferably in a range of from 67.6 mm to 101.4 mm.

4. Explanation of Operation of Outer Wall Section Structure

When respectively swinging out the leg side outer wall section 24 and the left and right side outer wall sections 25, 26 from the upstanding state illustrated in FIG. 1 and FIG. 4, etc., to the hanging state as illustrated for the outer wall sections 24, 25 in FIG. 6, first, locking of the respective outer wall sections 24 to 26 in a swung-back state by a lock device, in other words, the coupling members 54 and the engaged portions 55, are disengaged. Specifically, when a user or the like manually lifts, for example, the leg side outer wall section 24 from out of the outer wall sections 24 to 26 substantially upward, then the bearing members 64 illustrated in FIG. 2 shift inside the shaft bearing guides 63*a* of the attachment members 46 from being substantially at the bottom of the shaft bearing guides 63*a* to being substantially at the top thereof, and the coupling members 54 illustrated in FIG. 2 are pulled out from the engaged portions 55. Next, the user can swing the outer wall section 24 out from the upstanding state to the hanging state by swinging the outer wall section 24 about the respective left and right pair of swing support shafts 30, as swing pivot points, toward substantially the opposite direction to the infant accommodation space 27. Note that the out swing of the respective outer wall sections 24 to 26 can also be performed so as to be decelerated by a damping function of a damper (not illustrated in the drawings) capable of suppressing the swing speed of the out swing. Then, in order to swing the respective outer wall sections 24 to 26 in the hanging state back to the upstanding state, a user manually swing back the respective outer wall sections 24 to 26 about the pairs of swing support shafts 30 of the outer wall sections 24 to 26. Specifically, when a user or the like, in a reverse of the operation when being swung out, manually swings back the outer wall section 24, for example, out of the outer wall sections 24 to 26 with the respective pair of swing support shafts 30 acting as the pivot points, the coupling members 54 illustrated in FIG. 2 engage with the engaged portions 55, and the bearing members 64 illustrated in FIG. 2 shift inside the shaft bearing guides 63*a* back from being substantially at the top of the shaft bearing guides 63*a* to being substantially at the bottom thereof.

In order for a user or the like to manually remove the leg side outer wall section 24, for example, out of the outer wall sections 23 to 26, the user or the like continues the shift-out operation by manually manipulating the operation members 45 illustrated in FIG. 3A against the springs that is engaged with the respective spring engagement protrusions 67. Then, due to this shift-out operation, each of the swing support shafts 30 shifts out, through the intermediate state illustrated in FIG. 3B, to the non-engaged state with the attachment member 46 illustrated in FIG. 3C. Thus the user or the like can manually remove the leg side outer wall section 24 from the left and right pair of attachment members 46 of the mattress tray 16 by pulling substantially upward. Moreover, the user or the like can re-attach the leg side outer wall section 24 to the attachment members 46 of the mattress tray 16, as illustrated in FIG. 2, by performing an operation that is the reverse of the operation described above when pulling out the outer wall section 24.

The head side outer wall section 23, the left side outer wall section 25, and the right side outer wall section 26, respectively illustrated in FIG. 4 and FIG. 6, etc., each has a substantially similar, or substantially the same, attachment structure as the leg side outer wall section 24 and each may be respectively attached to the left and right pair, or the front and rear pair, of the attachment members 46 of the mattress tray 16. Thus the head side outer wall section 23, similarly to the leg side outer wall section 24 described above, can be removed from the respective left and right pair of attachment members 46 of the mattress tray 16, and attached to the respective left and right pair of the attachment members 46. Moreover, the left side outer wall section 25 and the right side outer wall section 26 each has a substantially similar, or substantially the same, attachment structure as the leg side outer wall section 24 and may be respectively attached to the front and rear pair of the attachment members 46 of the mattress tray 16.

The infant accommodation system 81 illustrated in FIG. 5 is in a different state to the infant accommodation system 81 illustrated in FIG. 4. The infant accommodation system 81 illustrated in FIG. 5 is in a state in which the head side outer wall section 23 and the leg side outer wall section 24 of the infant accommodation system 81 illustrated in FIG. 4 have been exchanged with each other. In order to perform such an exchange, first, the head side outer wall section 23 and the leg side outer wall section 24 are removed by performing a removal operation substantially similarly to, or substantially the same as, the removal of the leg side outer wall section 24 described above. Then, the head side outer wall section 23 is attached as illustrated in FIG. 5 to the left and right pair of attachment members 46 to which the leg side outer wall section 24 is attached in FIG. 4, and the leg side outer wall section 24 is attached as illustrated in FIG. 5 to the left and right pair of attachment members 46 to which the head side outer wall section 23 is attached in FIG. 4.

In the infant accommodation system 81, the head side outer wall section 23 and the leg side outer wall section 24 can be exchanged with each other as illustrated in FIG. 1, FIG. 4, and FIG. 5. In the infant accommodation system 81, normally, as illustrated in FIG. 1 and FIG. 4, the head side outer wall section 23 equipped with the cutout shaped indentation 31 and the grommet members 42 is adjacent to the ancillary equipment support column 22. Moreover, in the normal operation state illustrated in FIG. 1 and FIG. 4, the head of the infant is placed adjacent to the vicinity of inside the head side outer wall section 23, and the legs (in particular the feet) of the infant are placed adjacent to the vicinity of inside the leg side outer wall section 24. Hence, in the normal operation state, breathing tubes (not illustrated in the drawings) from resuscitation equipment (not illustrated in the drawings) can be extended, via the grommet members 42 of the head side outer wall section 23, to the proximity of the mouth of the infant. However, in the normal operation state described above, when a doctor or nurse or the like is performing some kind of treatment or the like in the proximity of the head of the infant, due to the presence of the support column 22 and the like, the doctor or nurse or the like needs to perform treatment in the proximity of the head of the infant from the vicinity of the support column 22. Note that in the normal operation state illustrated in FIG. 1 and FIG. 4, the doctor or nurse or the like might conceivably perform treatment in the proximity of the head of the infant by switching over the head side of the infant and the leg side of the infant. However, in such cases, breathing tubes from the resuscitation equipment extend over a comparatively long gap from the grommet members 42 on the head side outer wall section 23 to the proximity of the head of the infant. The breathing tubes accordingly may become twisted or kinked by the infant's own body movements, making it difficult to achieve a good supply of breathing gas from the breathing tubes to the infant.

In contrast thereto, in the event that the head side of the infant and the leg side of the infant are switched over and, as illustrated in FIG. 5, in cases in which the head side outer wall section 23 and the leg side outer wall section 24 are also exchanged with each other, the head side outer wall section 23 is positioned at a distance from the support column 22, etc. This thereby enables the doctor or nurse or the like to approach the proximity of the head of the infant, which is disposed at a position distanced from the support column 22, etc., substantially without consideration to the presence of the support column 22, etc. In such cases, the breathing tubes may be arranged to pass in the vicinity of the outer peripheral face of the outer wall section 25, 26 on the left side or the right side and pass through the grommet members 42. There is accordingly hardly any concern that the breathing tubes might be twisted or kinked by the infant's own body movements and the like. Moreover, the left side outer wall section 25 and the right side outer wall section 26 may also be exchanged, if the need arises. In cases in which at least one of the outer wall sections from out of the head side outer wall section 23, the leg side outer wall section 24, the left side outer wall section 25, and the right side outer wall section 26 has been damaged, etc., then the at least one outer wall section 23 to 26 can be replaced with a spare outer wall section.

Conceivably, as well as the head side outer wall section 23 equipped with the grommet members 42 and the cutout shaped indentation 31, the leg side outer wall section 24 may also be similarly equipped with the grommet members 42 and the cutout shaped indentation 31. However, in cases in which the outer wall sections 23, 24 are both respectively equipped with the grommet members 42 and the cutout shaped indentation 31, sometimes there are cases in which the grommet members 42 and the cutout shaped indentation 31 that have been respectively provided at the leg side outer wall section 24 obstruct the doctor or nurse or the like, as well as there being a comparatively high cost from respectively providing two sets of the grommet members 42 and the cutout shaped indentation 31. In contrast thereto, as illustrated in FIG. 4 and FIG. 5, the cutout shaped indentation 31 and the grommet members 42 are only respectively provided to one out of the head side outer wall section 23 and the leg side outer wall section 24. This thereby enables the four outer wall sections 23 to 26 to be provided at a comparatively low cost compared to cases in which the cutout shaped indentation 31 and the respective grommet members 42 are provided at both the head side outer wall section 23 and the leg side outer wall section 24.

Although detailed explanation has been given above of an exemplary embodiment of the present disclosure, the present invention is not limited to this exemplary embodiment, and various modifications and improvement are possible based on the scope as recited in the patent claims.

For example, in the above-described exemplary embodiment, the present disclosure is applied to an open incubator. However, the present disclosure may be applied to not only an open incubator, but also to an open and close incubator. In such cases, a substantially box-lid shaped upper hood that is capable of moving substantially upward and downward may be provided to enable the infant accommodation space 27 to be selectably covered from above. Such an upper hood may be configured with an upper face section that may be substantially transparent, and with upper side walls that may be substantially transparent, are substantially rectangular shaped when viewed in plan view, and project substantially downward from the vicinity of the outer periphery of the upper face section. Configuration can also be made such that the incubator becomes an open incubator by opening the upper face of the infant accommodation space 27 when the upper hood is raised, and becomes a closed incubator by closing the upper face of the infant accommodation space 27 when the upper hood is lowered.

Moreover, in the exemplary embodiment described above, the mattress tray 16 is configured in a substantially rectangular shape in plan view. However, the mattress tray 16 may be configured so as to be a substantially circular shape, a substantially elliptical shape, a substantially oval shape, or the like in plan view. The mattress tray 16 may also be configured as any substantially polygonal shape or the like other than a substantially rectangular shape in plan view.

What is claimed is:

1. An incubator comprising:

a mattress tray configured to accommodate an infant laid thereon; and a plurality of baby guards arranged to form an outer periphery of the mattress tray, wherein only a first baby guard of the plurality of baby guards includes a grommet and a cutout-shaped indentation, the first baby guard is substantially rectangular shaped similarly to a second baby guard of the plurality of baby guards except for being formed with the cutout-shaped indentation, the first baby guard is detachably attached to a first attachment location installed at a vicinity of the outer periphery of the mattress tray, the second baby guard is detachably attached to a second attachment location installed at a vicinity of the outer periphery of the mattress tray, the first baby guard is detachable from the first attachment location and attachable to the second attachment location, and the second baby guard is detachable from the second attachment location and attachable to the first attachment location each of the plurality of baby guards has a wall section body and a support member that is fixed to a lower end of the wall section body, and a portion of the respective wall section body that is adjacent to and substantially above an upper face of the respective support member is formed as a thickened portion having a substantially triangular shaped vertical cross-section, and the thickened portion is arranged along substantially the entire length of the respective baby guard in a substantially horizontal direction.

2. The incubator of claim 1, wherein the plurality of baby guards comprises a front side baby guard formed by the second baby guard, a rear side baby guard formed by the first baby guard, and a left side baby guard and a right side baby guard.

3. The incubator of claim 1, wherein an infant accommodation space having a substantially rectangular shape in plan view is configured by the plurality of baby guards.

4. The incubator of of claim 1, wherein the incubator is an open incubator.

5. The incubator of claim 1, wherein:

the cutout-shaped indentation is formed at the first baby guard so as to extend from a substantially central portion of an upper edge of the first baby guard to partway toward a lower edge of the first baby guard, the grommet is provided at least at a lower end of the cutout-shaped indentation, a plurality of inner wall sections are arranged at inner sides of the plurality of baby guards along an outer periphery of the mattress tray so as to be detachable from the mattress tray, and upper ends of the plurality of inner wall sections project further upward than the lower end of the cutout-shaped indentation.

6. The incubator of claim 1, wherein a lower end face of the respective thickened portion abuts substantially the upper face of the respective support member.

* * * * *